US012435459B2

(12) United States Patent
Echtermeyer

(10) Patent No.: US 12,435,459 B2
(45) Date of Patent: Oct. 7, 2025

(54) DETERGENT CONTAINER FOR A CLEANING DEVICE, CONTACTING APPARATUS, METHOD AND APPARATUS FOR OPERATING A CLEANING DEVICE, AND CLEANING DEVICE

(71) Applicant: Miele & Cie. KG, Guetersloh (DE)

(72) Inventor: Axel Echtermeyer, Rietberg (DE)

(73) Assignee: MIELE & CIE. KG, Gütersloh (DE)

( * ) Notice: Subject to any disclaimer, the term of this patent is extended or adjusted under 35 U.S.C. 154(b) by 436 days.

(21) Appl. No.: 17/795,340

(22) PCT Filed: Jan. 19, 2021

(86) PCT No.: PCT/EP2021/051062
§ 371 (c)(1),
(2) Date: Jul. 26, 2022

(87) PCT Pub. No.: WO2021/151727
PCT Pub. Date: Aug. 5, 2021

(65) Prior Publication Data

US 2023/0048461 A1 Feb. 16, 2023

(30) Foreign Application Priority Data

Jan. 30, 2020 (DE) ..... 10 2020 102 261.1

(51) Int. Cl.

| | |
|---|---|
| ***D06F 39/02*** | (2006.01) |
| ***D06F 33/47*** | (2020.01) |
| *D06F 103/22* | (2020.01) |
| *D06F 105/42* | (2020.01) |
| *D06F 105/58* | (2020.01) |

(52) U.S. Cl.
CPC ..... *D06F 39/02* (2013.01); *D06F 33/47* (2020.02); *D06F 2103/22* (2020.02); *D06F 2105/42* (2020.02); *D06F 2105/58* (2020.02)

(58) Field of Classification Search
CPC ..... D06F 33/47; D06F 39/02; D06F 2103/22; D06F 2105/42; D06F 2105/58
See application file for complete search history.

(56) References Cited

U.S. PATENT DOCUMENTS

2010/0161143 A1 6/2010 Smith

FOREIGN PATENT DOCUMENTS

| | | | |
|---|---|---|---|
| CN | 107558111 | A | 1/2018 |
| EP | 2003237 | A1 | 12/2008 |

OTHER PUBLICATIONS

Machine translation of CN 107558111A to Han et al. (Year: 2018).*
International Search Report dated Mar. 16, 2021.

* cited by examiner

*Primary Examiner* — Joseph L. Perrin
(74) *Attorney, Agent, or Firm* — Dickinson Wright PLLC

(57) ABSTRACT

A detergent container for a cleaning device (100) having a receiving slot and a contacting apparatus (106) for the detergent container (200). The detergent container has a housing for storing a detergent, wherein the housing is formed to be inserted into a receiving slot of the cleaning device (100). The detergent container has an electrically conductive contact region which is arranged on an outer side of the housing and includes a content encoding that represents a detergent container content. In the inserted state of the housing, the contact region can be contacted using the contacting apparatus (106) in order to detect the content encoding.

14 Claims, 5 Drawing Sheets

DETERGENT CONTAINER FOR A CLEANING DEVICE, CONTACTING APPARATUS, METHOD AND APPARATUS FOR OPERATING A CLEANING DEVICE, AND CLEANING DEVICE

RELATED APPLICATIONS

The present disclosure claims priority to and the benefit of PCT Application PCT/EP2021/051062, filed on Jan. 19, 2021, which claims priority to and the benefit of German Application 10 2020 102 261.1, filed on Jan. 30, 2020, the entire contents of which are incorporated herein by reference.

TECHNICAL FIELD

The disclosure relates to a detergent container for a cleaning device, to a contacting apparatus, to a method and an apparatus for operating a cleaning device, and to a cleaning device.

BACKGROUND

In the case of washing machines loaded with one or more cartridges, correct cartridge loading is necessary, for example, in order to supply different chemicals to the washing process in the correct doses.

The problem addressed by the approach presented herein is that of creating an improved detergent container for a cleaning device, an improved contacting apparatus, an improved method and an improved apparatus for operating a cleaning device, and an improved cleaning device.

SUMMARY

According to the disclosure, this problem is solved by a detergent container for a cleaning device, by a contacting apparatus, by a method and an apparatus for operating a cleaning device, and by a cleaning device having the features of the main claims. Advantageous embodiments and developments of the disclosure can be found in the subsequent dependent claims.

The advantages that can be achieved with the disclosure consist, in addition to a reduced risk of confusing cartridges to be used, in an improvement in ease of use for a user. Furthermore, compared to existing cleaning devices, a particularly cost-effective option of achieving said advantages is provided.

Against this background, a detergent container for a cleaning device having a receiving slot and a contacting apparatus for the detergent container is provided. The detergent container has a housing and a contact region. The housing is designed to store a detergent and can be inserted into the receiving slot of the cleaning device. The contact region is arranged on an outer side of the housing and is electrically conductive. The contact region represents a content encoding that represents a detergent container content. In the inserted state of the housing, the contact region can be contacted using the contacting apparatus in order to detect the content encoding.

The detergent container can be formed, for example, as a cartridge filled, for example, with a cleaning agent, which cartridge can be inserted into the cleaning device. The detergent container can be replaceable in order to be able to replace it with a new detergent container after it has been emptied, for example. The cleaning device can be realized as an automatic washing machine which can be in the form of a domestic appliance, for example. The contact region can have an at least partially metallic surface, for example. The content encoding can be used to distinguish, for example, which cleaning agent the detergent container contains. Therefore, detergent containers that store different cleaning agents can differ in their content encoding.

According to one embodiment, a position of the contact region on the housing can represent the content encoding. This means that the cleaning agent can be detected based on the position of the contact region. Different positions for arranging the respective contact region on the respective housing can thus be selected for different cleaning agents. In this case, the corresponding position can be selected from a plurality of predetermined possible positions. By arranging the contacting apparatus of the cleaning device such that it only contacts the contact region of an inserted detergent container if the contact region is located at a position corresponding to a position of the contacting apparatus, it can be very easily detected whether the correct detergent container is inserted.

The contact region can have a plurality of contact portions representing the content encoding. Contact regions of different detergent containers can thus also have a different content encoding if they are each arranged at the same position on the detergent containers. If the position of the contact regions is also varied, the number of possible content encodings increases. This thus advantageously allows for loading errors to be avoided, even if a large number of different detergent containers are available.

According to one embodiment, a first contact portion from the plurality of contact portions can be formed to be electrically conductive and a second contact portion from the plurality of contact portions can be formed to be electrically insulating. As a result, a pattern of electrically conductive and electrically insulating portions can be formed, by means of which pattern the content encoding can be formed.

The contact region can be formed as a label that can be glued onto the housing. As a result, production costs can advantageously be saved.

Furthermore, a contacting apparatus for contacting the contact region of at least one detergent container is provided in an aforementioned variant, wherein the contacting apparatus has two electrodes and a detection device. The two electrodes are designed to contact the contact region. The detection device is designed to detect the content encoding of the detergent container via a circuit routed via the two electrodes.

The contacting apparatus can be used, for example, in a cleaning device in order to detect the detergent container. The electrodes contact the contact region if the detergent container is correctly inserted into the cleaning device. The detection device can be designed to provide an electrical voltage necessary to realize the circuit. Furthermore, the detection device can comprise a suitable sensor device for detecting a closed circuit. The detection device can be realized as a control unit or integrated into a control unit for controlling operation of the cleaning device. As a result, a program of the cleaning device can advantageously be set on the basis of a detected content encoding.

According to one embodiment, the contacting apparatus can have a contact arm which can have the electrodes and two conducting paths for connecting the electrodes to the detection device. Reliable contacting of the contact region can be achieved by the contact arm, for example, in that the contact arm is designed to be resilient. In addition, by using the contact arm, a contact region arranged, for example, on an upper side of the housing of the detergent container can also be contacted.

The contacting apparatus can also have a third electrode. In this case, the detection device is designed to be able to detect the content encoding of the detergent container via a circuit routed via the third electrode, wherein the first electrode, the second electrode, and the third electrode can be arranged in a row or offset from one another. Advantageously, the electrodes can be arranged adjacent to one another, for example, parallel to one another. The number of possible content encodings can be increased by the third electrode.

According to one embodiment, the contacting apparatus can have two further electrodes for contacting a further contact region of a further detergent container. In this case, the detection device can be designed to be able to detect a content encoding of the further detergent container via a further circuit routed via the two further electrodes. As a result, for example, two detergent containers with different contents can advantageously be used and detected in the cleaning device.

According to one embodiment, the two electrodes can be arranged to contact the contact region of the detergent container inserted into a receiving region of the cleaning device if the contact region is located at a first position of the detergent container. Correspondingly, the two further electrodes can be arranged to contact the further contact region of the further detergent container inserted into a further receiving region of the cleaning device if the further contact region is located at a further position of the further detergent container. The first and the further position can differ from one another. In this way, detergent containers having contact regions located at different positions can be distinguished from one another and detected.

Furthermore, a method for operating a cleaning device having a contacting apparatus is provided in an aforementioned variant using a detergent container as previously mentioned. For this purpose, the method comprises a step of checking whether the circuit routed via the two electrodes is closed in order to obtain a test result, a step of providing an incorrect-loading signal using the test result if the test result does not indicate a closed circuit, and a step of providing a content signal representing a detergent container content using the test result if the test result indicates a closed circuit.

The method can be carried out, for example, in a cleaning device that comprises a contacting apparatus. The method can, for example, optionally output a message to a user using the incorrect-loading signal. This means that the user is advantageously informed if the detergent container was, for example, incorrectly inserted into the contacting apparatus. In this way, the operating safety of the user can advantageously be improved, and automatic program selection can thus also be made possible.

In addition, an apparatus is provided which is designed to carry out the steps of the method in the aforementioned variant.

The apparatus can be designed to read in input signals and to determine and provide output signals using the input signals. An input signal can represent, for example, a sensor signal that can be read in via an input interface of the apparatus. An output signal can represent a control signal or a data signal that can be provided at an output interface of the apparatus. The apparatus can be designed to determine the output signals using a processing specification implemented in the hardware or the software. For example, the apparatus can for this purpose comprise a logic circuit, an integrated circuit or a software module and can be realized as a discrete component or comprised by a discrete component.

A computer program product or computer program with program code which can be stored on a machine-readable carrier or storage medium, such as a semiconductor memory, a hard disk memory or an optical memory, is also advantageous. If the program product or program is executed on a computer or an apparatus, the program product or program can then be used to carry out, implement and/or control the steps of the method according to one of the embodiments described above.

Furthermore, a cleaning device is provided, having a contacting apparatus in one of the aforementioned variants and an apparatus as mentioned above.

The cleaning device can be in the form of a domestic appliance, for example. Alternatively, the approach described herein can be used accordingly in connection with a commercial or professional device, for example, a medical device such as a cleaning or disinfection device, a small sterilizer, a large-capacity disinfector, or a container washing system.

The approach presented herein also creates an apparatus designed to carry out, control or implement the steps of a variant of a method presented herein in corresponding devices. The problem addressed by the disclosure can also be solved quickly and efficiently by this embodiment variant of the disclosure in the form of an apparatus.

BRIEF DESCRIPTION OF THE DRAWINGS

An embodiment of the disclosure is shown in the drawings in a purely schematic manner and will be described in more detail below. In the drawings.

DETAILED DESCRIPTION OF THE DRAWINGS

Figure 1:
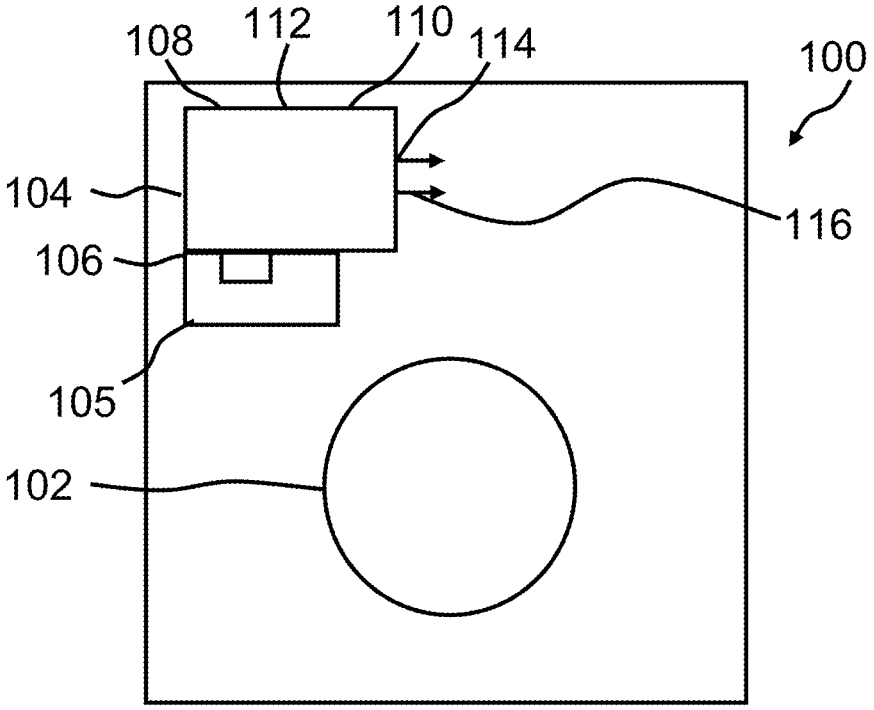
FIG. 1 shows a schematic representation of a cleaning device according to one embodiment.

FIG. 1 shows a schematic representation of a cleaning device 100 according to one embodiment. The cleaning device 100 is realized, for example, as a washing machine designed to clean items to be cleaned which are located in a laundry drum 102.

According to one embodiment, the cleaning device 100 comprises an apparatus 104 for operating the cleaning device 100. The apparatus 104 is designed, for example, to control a method for operating the cleaning device 100, as will be explained in more detail in one of the following figures. In particular, the apparatus 104 is designed to identify a detergent container accommodated in a receiving slot 105 of the cleaning device 100. The detergent container, also referred to as cartridge, can be inserted into the receiving slot 105 by a user of the cleaning device 100 and stores detergent, for example. A contacting apparatus 106 is arranged in the region of the receiving slot 105, which contacting apparatus allows electrical contacting of a contact region of the detergent container. The contacting apparatus 106 makes it possible to detect and identify a detergent container accommodated in the receiving slot. This is advantageous if the user has detergent containers with different contents available, which can all be inserted into the receiving slot 105 due to an identical external shape, for example. This thus ensures that detergent containers are not interchanged.

According to one embodiment, the apparatus 104 comprises a testing unit 108 and a provisioning unit 110. The testing unit is designed to check whether a circuit routed via the contacting apparatus 106 and the contact region of a detergent container accommodated by the receiving slot 105 is closed in order to obtain a test result 112. According to one embodiment, the provisioning unit 110 is designed to provide an incorrect-loading signal 114 using the test result 112 if the test result 112 does not indicate a closed circuit. For example, the incorrect-loading signal 114 can be suitable to indicate to a user using a display device that an incorrect detergent container is located in the receiving slot 105. According to one embodiment, the provisioning unit 110 is additionally or alternatively designed to provide a content signal 116 using the test result 112. In this case, the content signal 116 represents a content of the detergent container if the test result 112 indicates a closed circuit. The content signal 116 can be used, for example, to start a selected cleaning program because a correct detergent container has been detected. The content signal 116 can also be used to select and start a cleaning program matched with the content of the detected detergent container.

Figure 2:
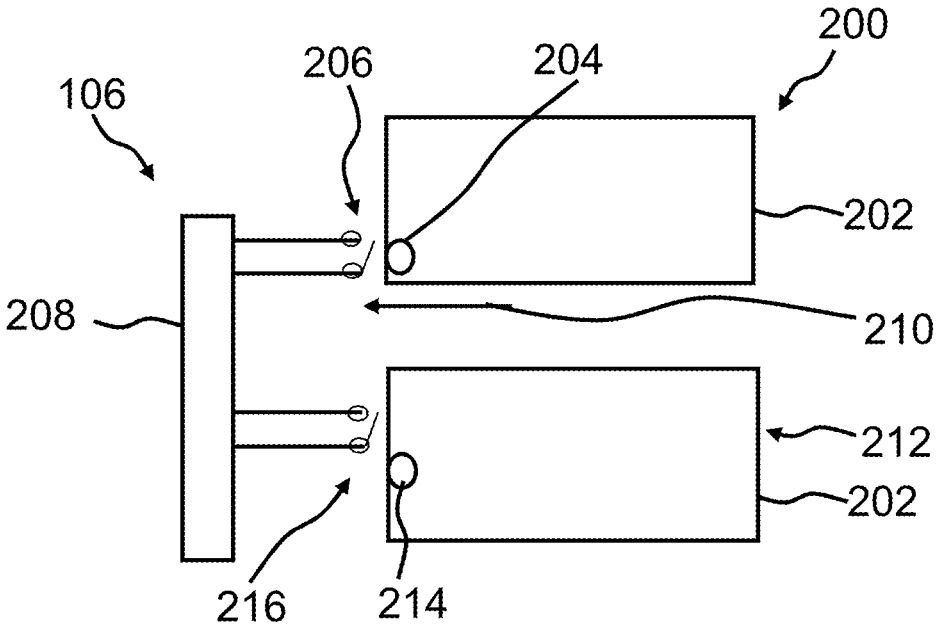
FIG. 2 shows a schematic representation of detergent containers according to one embodiment.

Additionally or alternatively, the apparatus 104 can comprise a detection device, as is described, for example, with reference to FIG. 2. The apparatus 104 can also be designed in the form of such a detection device. According to one embodiment, the contacting apparatus 106 is thus part of the apparatus 104.

Regardless of the exact design of the apparatus 104, an option is created to detect detergent containers in the cleaning device 100. According to one embodiment, this is achieved in that the detergent containers used have a housing with an axis of symmetry, wherein an electrically conductive means for forming a contact region is arranged outside the axis of symmetry. This ensures that different types of detergent containers are not interchanged. For this purpose, the apparatus 104 is designed, according to one embodiment, as a machine-side detection device that comprises at least two electrodes suitably arranged outside the axis of symmetry of a detergent container inserted into the receiving slot 105 in order to be able to distinguish between different types of detergent containers in one and the same receiving slot 105.

FIG. 2 shows a schematic representation of detergent containers 200, 212 according to one embodiment.

The detergent container 200 can be used, for example, in a cleaning device having a contacting apparatus 106, as was described with reference to FIG. 1. The detergent container 200 is formed as a cartridge, for example. In this case, the detergent container 200 has a housing 202 which is formed to store, for example, a detergent which is necessary for a washing process of the cleaning device. Known housings for cartridges can be used for this purpose. The housing 202 can be inserted into a receiving slot of the cleaning device.

The detergent container 200 has an electrically conductive contact region 204 which is arranged on an outer side of the housing 202 and represents a content encoding for detecting and identifying the detergent container 200. The content encoding thus represents a detergent container content of the detergent container 200. In the inserted state of the detergent container 200, the contact region 204 can be contacted using an electrode arrangement of, in this case for example, two electrodes 206 of the contacting apparatus 106 in order to detect the content encoding.

The contact region 204 is formed, for example, as a label which is glued onto the housing 202. Alternatively, the contact region 204 can also be printed on or manufactured in some other way.

According to this embodiment, the contact regions 204, 214 are realized as continuously electrically conductive surfaces. In this case, the contact regions 204, 214 can be formed to be, for example, circular or rectangular.

According to this embodiment, a position of the contact region 204 on the housing 202 represents the content encoding. For example, the position in relation to an axis of symmetry of the housing 202 is located on a first housing half of the housing 202. In the case of other detergent containers with different contents, a corresponding contact region 204 can be located at a different position, for example, on a second housing half or on the axis of symmetry of the corresponding housing.

An outer surface of the housing 202 can thus be divided into a plurality of segments. A special content can be assigned to each of the segments. For example, different detergent types can thus be assigned to different segments. The contact region 204 is located in the segment which is assigned to the detergent type located in the respective detergent container 200.

The contact region 204 is designed to be electrically conductive in order to close an electric circuit if there is contact with the two electrodes 206 of the contacting apparatus 106. This is shown schematically in FIG. 2 by a switch which is still open, since the detergent container 200 has not yet been fully inserted into the receiving slot.

The contacting apparatus 106 further comprises a detection device 208. The detection device 208 is designed to detect the content encoding of the detergent container 200 via a circuit routed via the two electrodes 206. When the detergent container 200 is fully inserted into the cleaning device along an insertion direction 210, the two electrodes 206 contact the contact region 204, thus closing the circuit.

If another detergent container is to be inserted, in which the contact region 204 is located at a different position, for example, in a different segment of the housing 202, the two electrodes 206 would not contact the contact region 204 and therefore not close the circuit via the two electrodes 206.

According to one embodiment, the segments in which contact regions can be arranged are arranged on the upper side of the housing 202, adjacent to a front edge of the housing 202 in the insertion direction 210. In this way, the contact region 204 can easily be contacted via the contacting apparatus 106.

According to this embodiment, a further detergent container 212 can be inserted into the cleaning device adjacent to the detergent container 202.

The further detergent container 212 has a further contact region 214. The further contact region 214 is arranged, with regard to the contact region 204, at a different position, for example, in a different segment of the housing 202. The further contact region 214 thus characterizes a content that differs from the content of the detergent container 200. The two detergent containers 200, 212 can thus be distinguished from one another by the different positions of their contact regions 204, 214.

A further electrode arrangement, in this case for example, two further electrodes 216, is provided for detecting the further detergent container 212. The two further electrodes 216 are positioned differently from the two electrodes 206. While the two electrodes 206 can contact the contact region 204 arranged at a first position, the two further electrodes 216 are arranged such that they can contact a contact region arranged at a second position. In this case, the first position and the second position are, for example, on different sides of an axis of symmetry of the housing 202.

Since the contact region 214 of the detergent container 212 is located at a third position, in this case for example on the axis of symmetry of the housing 202, the two further electrodes 216 cannot contact this contact region 214. At least in the portion provided for arranging contact regions, the outer surface of the housing 202 is formed to be electrically insulating. As a result, a further circuit routed via the two further electrodes 216 is not closed. This is detected by the detection device 208. It is thus detected that the further detergent container 212 according to this embodiment has been inserted incorrectly. However, if the position of the contact region 214 of the further detergent container 212 were to correspond to the positioning of the two further electrodes 216, the detection device 208 would detect a correctly inserted detergent container.

According to an alternative embodiment, the two electrodes 206 and the two further electrodes 216 are not arranged at different heights, as is shown in FIG. 2, but at the same height in relation to the respective detergent container 202, 212. In this case, the positions of the contact regions 204, 214 on the respective housings 202 do not differ. In order to still be able to identify the different contents of the different detergent containers 200, 212, the contact regions 204, 214 are shaped differently. This means that the content encoding is realized, for example, by the surface shown in one of the following figures as an identification feature. For this purpose, the respective electrode arrangements can optionally have more than the two electrodes 206, 216 shown in FIG. 2.

In other words, an option is described for identifying, for example, one or optionally a plurality of detergent containers 200, 212 of the same type which are inserted into at least one receiving region designed for this purpose. The detergent containers 200, 212 can optionally be latched, for example, by means of a lug arranged at one end of the detergent containers 200, 212, which lug is arranged, for example, behind a spring latch on a container assembly. The detergent containers 200, 212 contain, for example, different types of detergent components, which are requested and pumped out differently by the respectively desired washing program in a correct dosing interaction for a washing effect and bleaching of the items to be cleaned. Therefore, a correct assignment to a corresponding compartment, for example, is necessary. Due to the identical containers, i.e., due to a similar formation of the housing 202 of the detergent containers 200, 212, using different filling and labelling, the approach presented herein prevents the detergent containers 200, 212 from being interchanged such that the detergent containers 200, 212 can be detected in the respective compartment, and the customer is only optionally provided with a display for incorrect loading. Furthermore, for example, with a system extension, a content detection also takes place. This can in turn be extended, for example, to an automatic program setting.

According to this embodiment, each detergent container 200, 212 also has a contact region 204, 214, for example, in the form of an adhesive region or a small adhesive label, with an electrically conductive surface when it is assembled to match the content and a label.

By correctly loading the detergent containers 200, 212, the electrically conductive contact region 204, 214 on the respective housing 202 makes contact with contacts which herein are referred to as two electrodes 206, 216. According to one embodiment, the two electrodes 206, 216 are each arranged on an upper side of a limit switch lever. For example, in the case of incorrect loading, such as interchanging detergent containers 200, 212, no electrical connection is established between the contact region 204, 214 and the electrodes 206, 216. In other words, each of the contact regions 204, 214 thus acts as a switch with a lever force, for example, in the direction of a circuit board layout comprising the detection device 208.

As shown with reference to the subsequent figures, different detergent contents can be displayed using different coding options in the form of different configurations of the contact regions. In order to identify the respective detergent content, the contact regions are divided and the number of contacting conducting paths and thus also of the electrodes is optionally increased. For example, three different contents per detergent container are distinguished in each case by three electrodes. In such a case, for example, a total of six different detergents can be assigned to two receiving slots, also referred to as compartments 1 and 2. The position of the differently segmented contact regions on the respective housing can be identical in each case. The distinction can be made solely by the fact that each segmentation causes a circuit through a pair of electrodes of the contacting apparatus assigned precisely to this segmentation.

Figure 3:
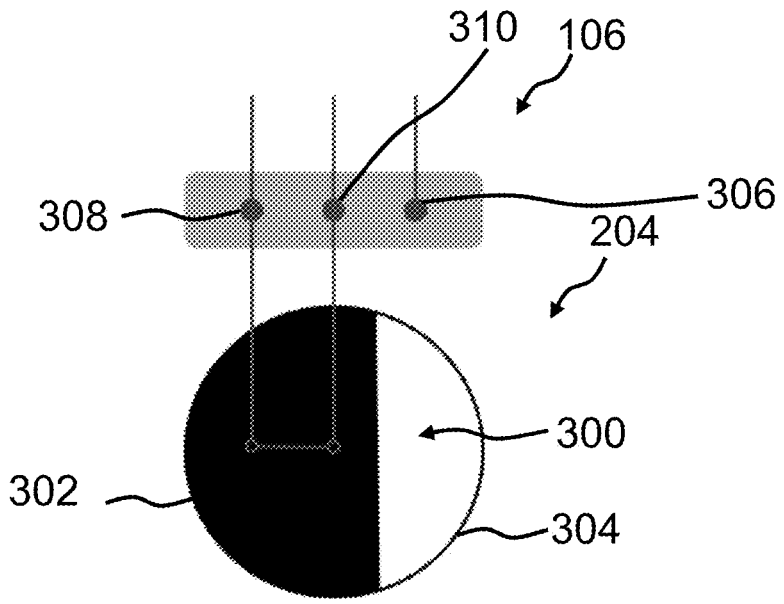
FIG. 3 shows a schematic representation of a contact region according to one embodiment.

FIG. 3 shows a schematic representation of a contact region 204 according to one embodiment. The contact region 204 can, for example, correspond or be similar to a contact region described in FIG. 2 or, instead of such a contact region, be arranged on a detergent container that is used or is usable in a cleaning device described in FIG. 1. According to this embodiment, the contact region 204 has a plurality of contact portions 300 representing the content encoding. According to this embodiment, a first contact portion 302 is formed to be electrically conductive, and a second contact portion 304 is formed to be electrically insulating.

In the embodiment shown here, the contact region 204 electrically conductively connects two electrodes 308, 310 of an electrode arrangement, which in this case has three electrodes 306, 308, 310, via the first contact portion 302 of the contacting apparatus 106, so that a circuit is closed via the two electrodes 308, 310.

However, a further circuit routed via the third electrode 306 is not closed, since the third electrode 306 contacts the electrically insulating second contact portion 304.

According to this embodiment, the first electrode 308 and the second electrode 310 make the closed circuit possible through the first contact portion 302. According to this embodiment, no current flows through the third electrode 306 because it is arranged at the level of the insulating region, i.e., at the level of the second contact portion 304. This means that an identification of a content of the detergent container is possible thereby, which of the electrodes 308, 310, 310 make the closed circuit possible. Since the content encoding according to this embodiment is carried out by means of the conductivity of the contact portions 300 and not by means of the position, it is possible according to this embodiment to arrange the contact region 204 of the detergent container and, for example, the further contact region of the further detergent container at the same position, respectively.

In other words, the contacting apparatus 106 according to this embodiment has an increased number of electrodes 308, 310, 306 when compared to the two electrodes described with reference to FIG. 2. The content encoding is thus created with a layout adaptation on the detection device, which is also referred to as electronics, in coordination with the contact region 204 on each detergent container.

By way of example, the contact portions 302, 304 according to the embodiment shown are arranged in a strip-shaped manner next to one another. In this case, the first contact portion 302 has a greater width than the second contact portion 304. The first contact portion 302 occupies two thirds of the width of the contact region 204, and the second contact portion 304 occupies one third of the width of the contact region 204. A separating line between the contact portions 302, 304 runs, for example, parallel to the axis of symmetry mentioned with reference to FIG. 2. By way of example, the contact region 204 has a round shape.

Figure 4:
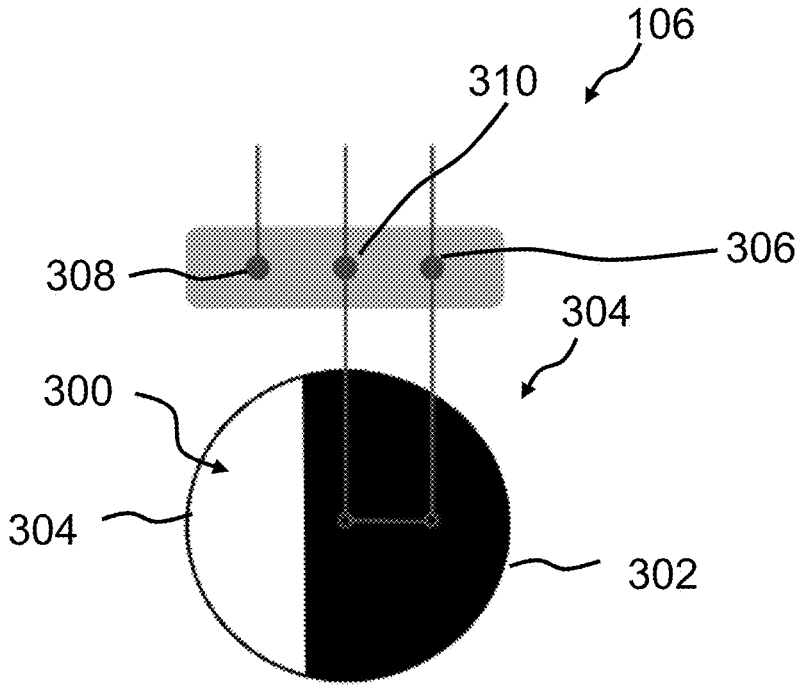
FIG. 4 shows a schematic representation of a contact region according to one embodiment.

FIG. 4 shows a schematic representation of a contact region 404 according to one embodiment. The contact region 404 shown here corresponds to the contact region described with reference to FIG. 3, but in this case, the contact portions 302, 304 are arranged interchanged. This allows for a closed circuit via the second electrode 310 and the third electrode 306. No current flow is possible via the first electrode 308 because the first electrode 308 contacts the electrically insulating second contact portion.

Figure 5:
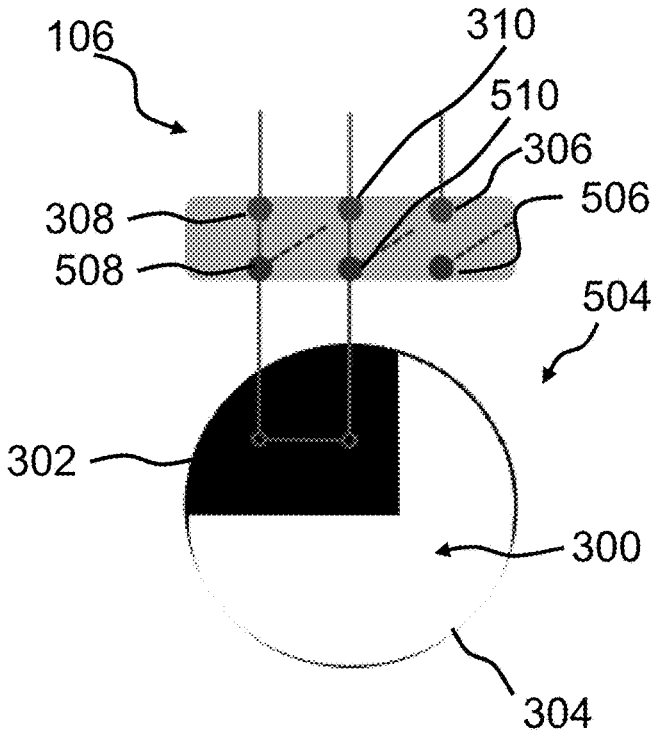
FIG. 5 shows a schematic representation of a contact region according to one embodiment.

FIG. 5 shows a schematic representation of a contact region 504 according to one embodiment. The contact region 504 shown here also has an electrically conductive first contact portion 302 and an electrically insulating second contact portion 304. In contrast to the embodiment shown in FIG. 3, the first contact portion 302 only extends over half the length of the contact region 504, based on the aforementioned axis of symmetry which runs, for example, parallel to the insertion direction of a detergent container shown in FIG. 2. The first contact portion 302 extends over the half of the contact region 504 located closer to the contacting apparatus 106.

This segmentation allows for the number of possible combinations for arranging the two contact portions 302, 304 to be increased. For this purpose, however, it is necessary for the contacting apparatus 106 to have further electrodes 506, 508, 510 arranged in a second row in addition to the electrodes 306, 308, 310 arranged in a first row. The two rows are arranged in parallel.

According to this embodiment, the first contact portion 302 exclusively closes a circuit via the electrodes 308, 310.

According to one embodiment, the number of electrodes is increased to at least four, for example, on an upper side and on an underside of the contacting apparatus 106 in the operational state when compared to the embodiment described with reference to FIG. 2.

Figure 6:
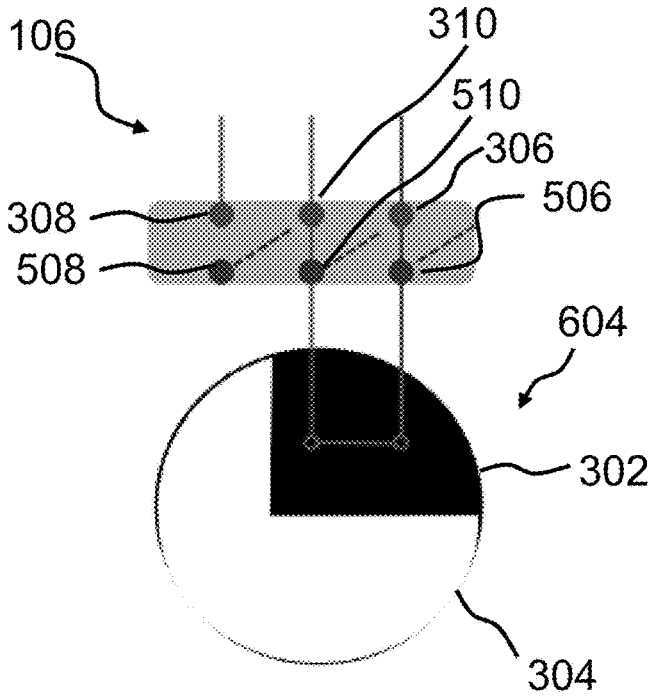
FIG. 6 shows a schematic representation of a contact region according to one embodiment.

FIG. 6 shows a schematic representation of a contact region 604 according to one embodiment. The contact region 604 shown here differs from the contact region described in FIG. 5 in the arrangement of the contact portions 302, 304. In contrast to the embodiment shown in FIG. 4, the first contact portion 302 only extends over half the length of the contact region 604. The first contact portion 302 extends over the half of the contact region 604 located closer to the contacting apparatus 106.

According to this embodiment, the first contact portion 302 exclusively closes a circuit via the electrodes 306, 310.

Figure 7:
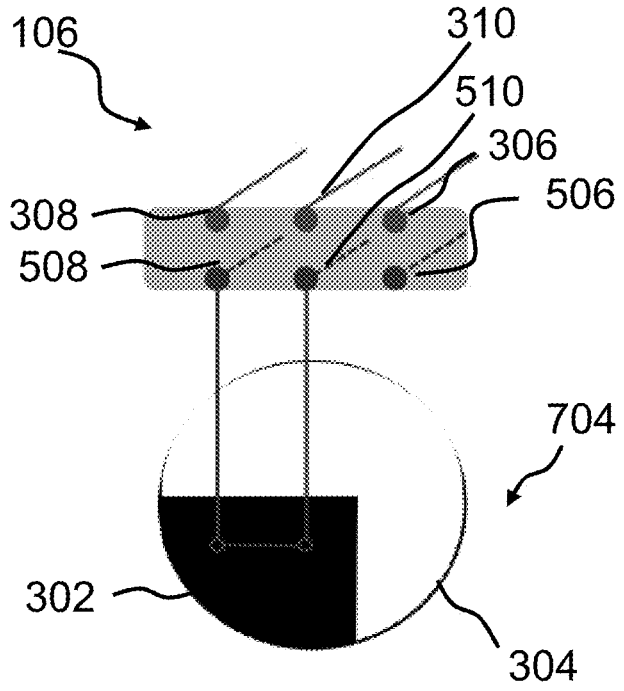
FIG. 7 shows a schematic representation of a contact region according to one embodiment.

FIG. 7 shows a schematic representation of a contact region 704 according to one embodiment. The contact region 704 shown here differs from the contact region described in FIG. 5 in the arrangement of the contact portions 302, 304. In contrast to the embodiment shown in FIG. 3, the first contact portion 302 only extends over half the length of the contact region 704, based on the aforementioned axis of symmetry which runs, for example, parallel to the insertion direction of a detergent container shown in FIG. 2. The first contact portion 302 extends over the half of the contact region 704 further away from the contacting apparatus 106.

According to this embodiment, the first contact portion 302 exclusively closes a circuit via the electrodes 508, 510.

Figure 8:
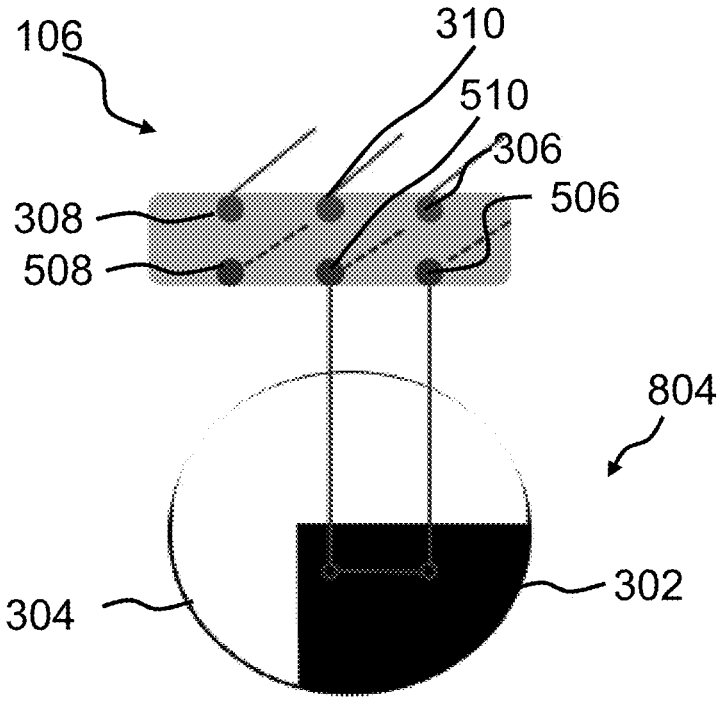
FIG. 8 shows a schematic representation of a contact region according to one embodiment.

FIG. 8 shows a schematic representation of a contact region 804 according to one embodiment. The contact region 804 shown here differs from the contact region described in FIG. 7 in the arrangement of the contact portions 302, 304. In contrast to the embodiment shown in FIG. 4, the first contact portion 302 only extends over half the length of the contact region 804. The first contact portion 302 extends over the half of the contact region 804 further away from the contacting apparatus 106.

According to this embodiment, the first contact portion 302 exclusively closes a circuit via the electrodes 506, 510.

Figure 9:
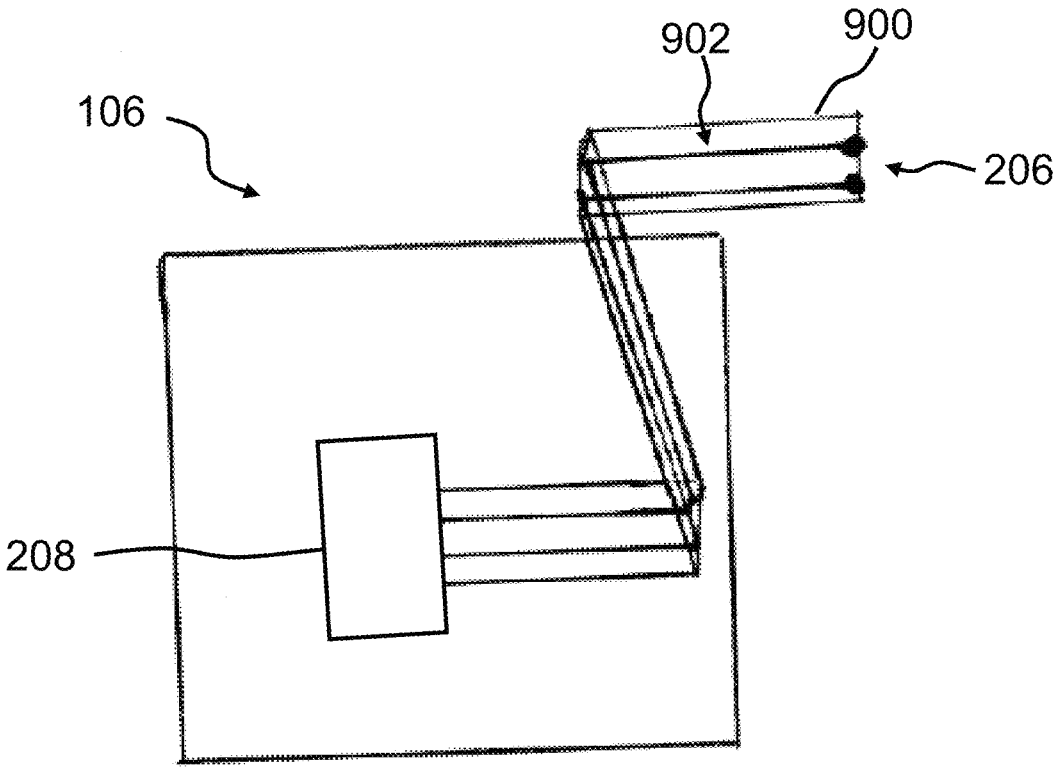
FIG. 9 shows a schematic representation of a contacting apparatus according to one embodiment.

FIG. 9 shows a schematic representation of a contacting apparatus 106 according to one embodiment. The contacting apparatus 106 can correspond or be similar to the contacting apparatus 106 described in FIG. 1 or 2. The contacting apparatus 106 is formed to contact the contact region of at least one detergent container. For this purpose, the contacting apparatus 106 has the two electrodes 206 and the detection device 208 which is designed to detect the content encoding of the detergent container via the circuit routed via the two electrodes 206. According to this embodiment, the contacting apparatus 106 has a contact arm 900 which has the electrodes 206 and two conducting paths 902 for connecting the electrodes 206 to the detection device 208.

In other words, according to this embodiment, the contact arm 900, which is also referred to as the limit switch lever, contains at least two conducting paths 902 for the function of contacting the switch in the direction of the detection device 208.

The detergent container has the contact region on a connection side. The contact region has an electrically conductive surface and optionally very good adhesive strength. In this case, the lever arm 900 has integrated conducting paths 902. These conducting paths 902 are short-circuited on a pressure-actuating side by the conductive contact region when loading the detergent container. According to one embodiment, the electrical connection to the detection device 208 thus established takes place, for example, on another lever side of the contact arm 900 by contact pressure of the loaded detergent container. The short circuit, i.e., the closed circuit, only takes place with a properly loaded detergent container cartridge.

According to an alternative embodiment, the contact arm 900 comprises further conducting paths and further electrodes, for example, to be able to evaluate the formations of contact regions described with reference to FIGS. 3 to 8.

Figure 10:
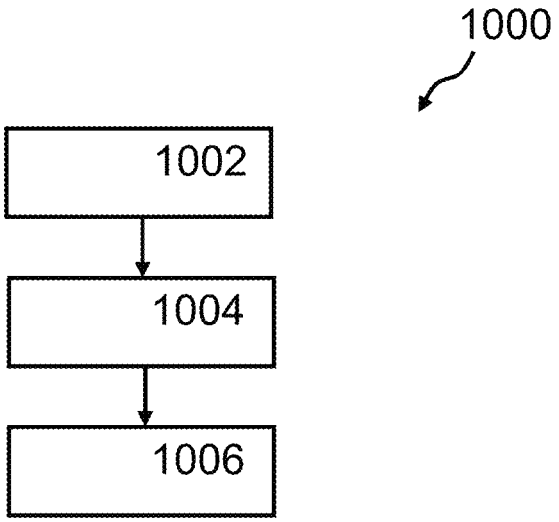
FIG. 10 shows an embodiment of a flowchart of a method for operating a cleaning device having a contacting apparatus.

FIG. 10 shows an embodiment of a flowchart of a method 1000 for operating a cleaning device having a contacting apparatus. The method 1000 can be carried out in a cleaning device, as was described, for example, in FIG. 1. The method 1000 is carried out using a detergent container, as was described in FIG. 2. The method 1000 comprises a step 1002 of checking whether the circuit routed via the two electrodes is closed in order to obtain a test result, a step 1004 of providing an incorrect-loading signal using the test result if the test result does not indicate a closed circuit, and a step 1006 of providing a content signal using the test result if the test result indicates a closed circuit, wherein the content signal represents a detergent container content.

The invention claimed is:

1. A detergent container (200) for a cleaning device (100), the cleaning device having a receiving slot and a contacting apparatus (106) for the detergent container (200), the contacting apparatus having at least two electrodes, the detergent container (200) comprising:

a housing (202) configured to store a detergent, wherein the housing (202) is formed to be inserted into the receiving slot of the cleaning device (100); and an electrically conductive contact region (204) arranged on an outer side of the housing (202), wherein the contact region (204) includes an electrically conductive continuous surface representing a content encoding that represents a detergent container content, wherein, in the inserted state of the housing (202), the contact region (204) can be contacted by at least two of the at least two electrodes of the contacting apparatus (106) in order to detect the content encoding based on the relative position of the at least two electrodes to the electrically conductive continuous surface of the contact region, the relative position being in a plane of the electrically conductive continuous surface and adjustable via a placement position of the contact region (204) on the outer side of the housing (202) or via configuration of conductive pathways within the electrically conductive continuous surface of the contact region (204).

2. The detergent container (200) according to claim 1, wherein a position of the contact region (204) on the housing (202) is indicative of the content encoding.

3. The detergent container (200) according to claim 1, wherein the contact region (204) has a plurality of contact portions (300) having the content encoding.

4. The detergent container (200) according to claim 3, wherein a first contact portion (302) from the plurality of contact portions (300) is formed to be electrically conductive and a second contact portion (304) from the plurality of contact portions (300) is formed to be electrically insulating.

5. The detergent container (200) according to claim 1, wherein the contact region (204) is formed as a label which is adhered onto the housing (202).

6. The contacting apparatus (106) configured to contact the contact region (204) of at least one detergent container (200) configured according to claim 1, wherein the contacting apparatus (106) comprises:

two electrodes (206) configured for contacting the contact region (204); and a detection device (208) configured to detect the content encoding of the detergent container (200) by way of a circuit routed via the two electrodes (206) being in contact with the contact region (204) having the electrically conductive continuous surface, the content encoding being detected based on a relative position of the at least two electrodes to the electrically conductive continuous surface of the contact region, the relative position being in a plane of the electrically conductive continuous surface and adjustable via a placement position of the contact region on an outer side of the housing or via configuration of conductive pathways within the electrically conductive continuous surface of the contact region.

7. The contacting apparatus (106) according to claim 6, further comprising a contact arm (900) which has the two electrodes (206) and has two conducting paths (902) for connecting the electrodes (206) to the detection device (208).

8. The contacting apparatus (106) according to claim 6, further comprising a third electrode (306), wherein the detection device (208) is configured to detect the content encoding of the detergent container (200) by way of a circuit routed via the third electrode (306), wherein the first electrode (308), the second electrode (310), and the third electrode (306) are arranged in a row or are offset from one another.

9. The contacting apparatus (106) according to claim 6, further comprising two additional electrodes (216) for contacting an additional contact region (214) of an additional detergent container (212), and wherein the detection device (208) is designed to detect a content encoding of the additional detergent container (212) via an additional circuit routed via the two additional electrodes (216).

10. The contacting apparatus (106) according to claim 9, wherein the two electrodes (206) are arranged to contact the contact region (204) of the detergent container (200) inserted into a receiving region of the cleaning device (100) if the contact region (204) is located at a first position of the detergent container (200), and wherein the two additional electrodes (216) are arranged to contact the additional contact region (214) of the additional detergent container (212) inserted into an additional receiving region of the cleaning device (100) if the further contact region (214) is located at a further position of the further detergent container (212), wherein the first and the further position differ from one another.

11. A method (1000) for operating the cleaning device (100) having the receiving slot and the contacting apparatus (106) with a detection device that forms a circuit with two electrodes (206), the cleaning device configured for receiving a detergent container (200) configured according to claim 1, the two electrodes contacting a contact region (204) on the detergent container when received in the receiving slot, wherein the method (1000) comprises the following steps:

checking (1002) whether the circuit routed via the two electrodes (206) is closed in order to obtain a test result (112);

providing (1004) an incorrect-loading signal (114) using the test result (112) if the test result (112) does not indicate a closed circuit; and providing (1006) a content signal (116) representing a detergent container content using the test result (112) if the test result (112) indicates a closed circuit, the content signal being based on a relative position of the at least two electrodes to the electrically conductive continuous surface of the contact region, the relative position being in a plane of the electrically conductive continuous surface and adjustable via a placement position of the contact region on an outer side of the housing or via configuration of conductive pathways within the electrically conductive continuous surface of the contact region.

12. An apparatus (104) configured to carry out the steps (1002, 1004, 1006) of the method (1000) according to claim 11.

13. A computer program product with program code for carrying out the method (1000) according to claim 11, wherein the computer program product is executed on an apparatus.

14. A cleaning device (100) comprising:

a cleaning apparatus (104) having a receiving slot and a contacting apparatus (106), the contacting apparatus having at least two electrodes (206) and a detection device (208) configured to detect a content encoding by way of a circuit routed via the at least two electrodes (206); and a detergent container (200) for the cleaning apparatus (104), the detergent container having a housing (202) configured to store a detergent, wherein the housing (202) is formed to be inserted into the receiving slot of the cleaning device (100); and an electrically conductive contact region (204) arranged on an outer side of the housing (202), wherein the contact region (204) includes an electrically conductive continuous surface representing the content encoding which represents a detergent container content, wherein, in the inserted state of the housing (202), the contact region (204) is contacted by at least two of the at least two electrodes of the contacting apparatus (106) in order to detect the content encoding based on a relative position of the at least two electrodes to the electrically conductive continuous surface of the contact region, the relative position being in a plane of the electrically conductive continuous surface and adjustable via a placement position of the contact region on an outer side of the housing or via configuration of conductive pathways within the electrically conductive continuous surface of the contact region.

* * * * *